United States Patent [19]

Kelley et al.

[11] 4,145,028

[45] Mar. 20, 1979

[54] PORTABLE POWER WINCH ASSEMBLY

[75] Inventors: Omer J. Kelley, Colorado Springs; Judson M. Harper, Fort Collins, both of Colo.

[73] Assignee: KOFK, Inc., Pueblo, Colo.

[21] Appl. No.: 862,442

[22] Filed: Dec. 19, 1977

[51] Int. Cl.[2] ..... B66D 3/00

[52] U.S. Cl. ..... 254/186 R; 224/263; 242/54 R

[58] Field of Search ..... 228/25 A, 5 R, 5 A, 228/5 B; 254/150, 151, 154, 186 R; 242/96, 106, 54 R; 224/8 R, 8 A, 9, 25 R

[56] References Cited

U.S. PATENT DOCUMENTS

| | | | |
|---|---|---|---|
| 2,563,195 | 8/1951 | Soule et al. | 224/5 B UX |
| 2,576,755 | 11/1951 | Gaskins et al. | 254/154 |
| 3,124,336 | 3/1964 | Scanlin et al. | 254/186 R |
| 3,197,162 | 7/1965 | Johanson et al. | 254/186 R X |
| 3,829,064 | 8/1974 | Jackson | 254/186 R X |
| 3,885,722 | 5/1975 | Robertson | 224/25 A |
| 3,915,432 | 10/1975 | Bustamante | 254/154 X |

*Primary Examiner*—Edward R. Kazenske
*Assistant Examiner*—Jerold M. Forsberg
*Attorney, Agent, or Firm*—Clarence A. O'Brien; Harvey B. Jacobson

[57] ABSTRACT

A support frame equipped with shoulder straps is provided for support from the back of a hunter and a combined motor and winch assembly including a rotary winding member driven from the motor is supported from the frame. The motor and winch assembly projects outwardly of the side of the frame opposite from the side thereof which opposes the back of the person over whose shoulders the shoulder straps pass and the combined motor and winch assembly is supported from a base plate removably supported from the frame. The base plate includes fair lead structure for guiding the free end of an elongated flexible tension member wound on the rotary winding member and the side of the plate remote from the fair lead structure includes anchor structure spaced therealong on a line generally normal to a line extending between the winding member and the fair lead structure. The anchor means is of a construction enabling the opposite ends of a ground anchored bridle to be anchored relative thereto. The motor is drivingly connected to the winding member through a gear reduction assembly and a releasable clutch whereby the clutch may be released in order to enable free wheeling rotation of the winding member during the process of unwinding the associated flexible tension member therefrom.

5 Claims, 8 Drawing Figures

PORTABLE POWER WINCH ASSEMBLY

BACKGROUND OF THE INVENTION

There are many people each year who hunt deer, elk, bear and/or other large game. Most of these animals that are killed fall in areas not immediately accessible to trails or roads over which motorized vehicles may travel and in such instances the killed animals must be transported to the nearest trail or road in order to be loaded onto a motorized vehicle. While some hunters use horses, most hunters hunt while on foot and although smaller kills may be readily carried, most deer, elk, and bear may not be readily carried.

Accordingly, when a hunter hunting large animals makes a kill, he must either drag his kill to the nearest trail or road or he must cutup his kill and carry it out in small pieces. In any event, the task of transporting a large kill to the nearest road or trail over which a motorized vehicle may travel is difficult and extremely timeconsuming. Further, if the kill is dragged to the nearest trail or road, a considerable portion of the meat may be cutup by contact with the ground and rocks and thus be wasted. Accordingly, a need exists for a means whereby even a heavy kill may be reasonably easily transported from the area of the kill to the nearest road or trail over which a motorized vehicle may pass.

Various forms of winch assemblies including some of the general structural and operational features of the instant invention are disclosed in U.S. Pat. Nos. 2,746,583, 2,936,915, 2,991,977, 3,124,336, 3,467,359, and 3,645,503.

BRIEF DESCRIPTION OF THE INVENTION

The portable power winch of the instant invention has been specifically designed to enable a hunter to drag a large kill from the point of kill to a road or trail along which a motorized vehicle may travel. The instant invention comprises a portable power winch which may be packed on the back of the hunter to the location in which he intends to hunt and the hunter may also pack a lightweight sled (undisclosed) or a companion may pack such a lightweight sled. The sled may be used to support a large kill on the ground and the portable power winch may be utilized to drag the sled over the ground with the kill thereon to a road or trail along which a motorized vehicle may travel.

Another object of this invention is to provide a portable power winch in accordance with the preceding object and constructed in a manner whereby it may be readily anchored relative to a tree or the ground.

Still another object of this invention is to provide a portable power winch removably supported from a backpack frame of lightweight construction whereby the portable power winch may be readily packed to the area in which a hunter desires to hunt.

Another very important object of this inventin is to provide a power winch including a winding member driven from a power head such as the power head of a portable chain saw.

Yet another object of this invention is to provide a portable power winch in accordance with the immediately preceding object and including a gear reduction assembly and disengageable clutch for selectively drivingly coupling the motor of the power winch to the rotatable winding member thereof.

A final object of this invention to be specifically enumerated herein is to provide a portable power winch in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
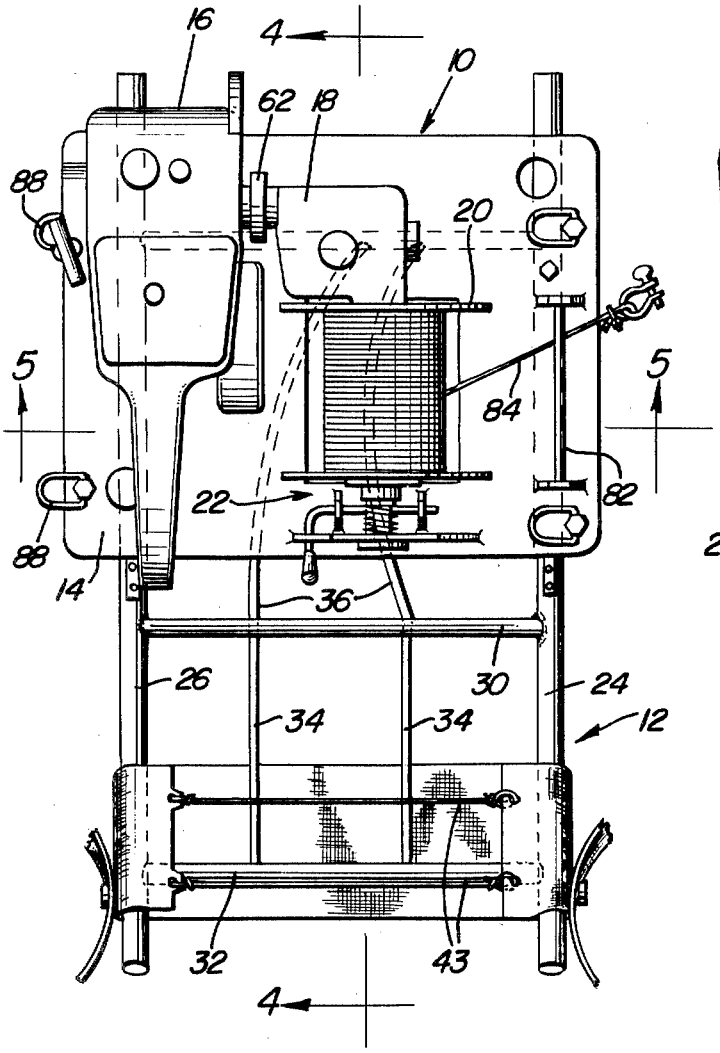
FIG. 1 is a rear elevational view of the portable power winch assembly of the instant invention.
Figure 2:
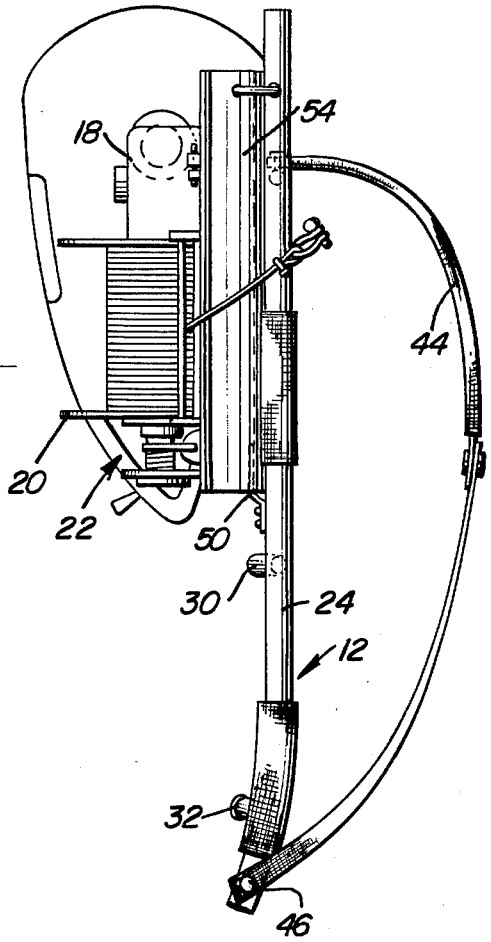
FIG. 2 is a side elevational view of the assemblage illustrated in FIG. 1 as seen from the right side thereof.
Figure 3:
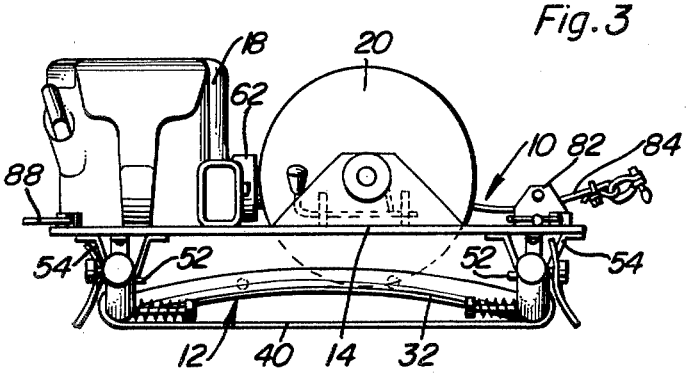
FIG. 3 is an elevational view of the power winch assembly as seen from the lower side of FIG. 1.
Figure 4:
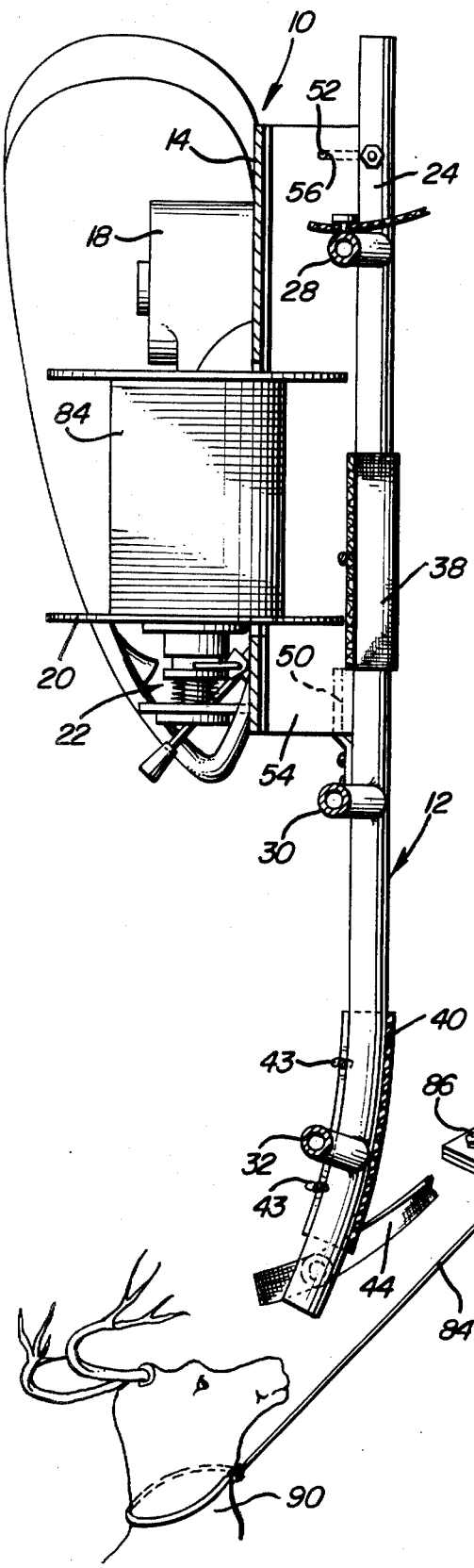
FIG. 4 is a vertical sectional view taken substantially upon the plane indicated by the section line 4—4 of FIG. 1.
Figure 7:
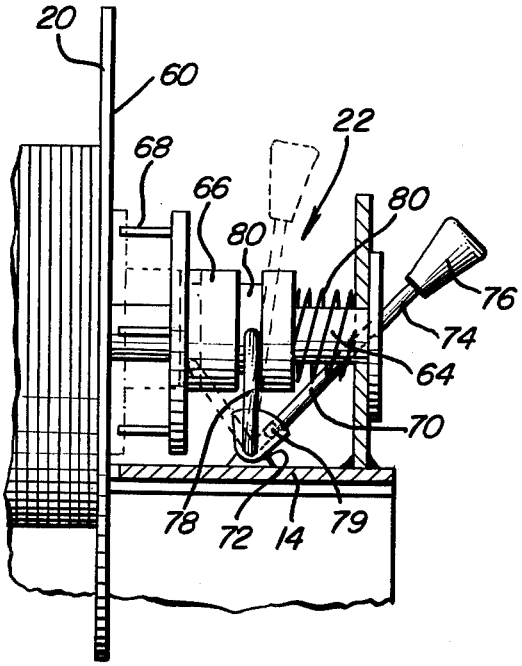
FIG. 7 is a fragmentary vertical sectional view on somewhat of an enlarged scale illustrating the clutch assembly of the winch.
Figure 8:
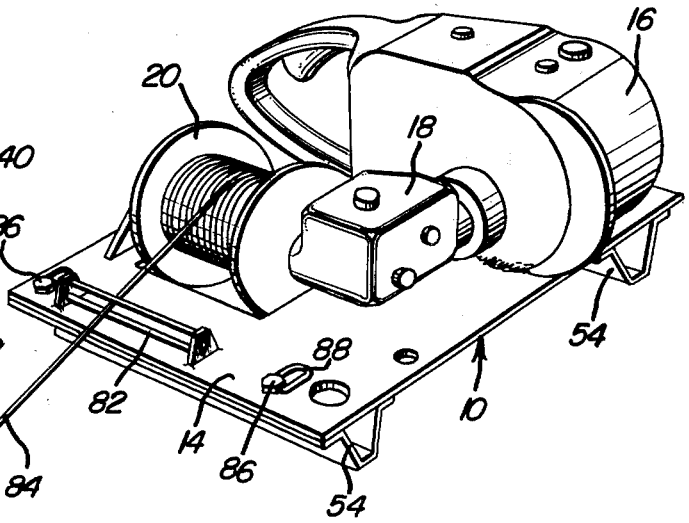
FIG. 8 is a perspective view of the portable power winch removed from the backpack frame portion thereof and with the free end of the elongated tension member wound on the winding member of the winch engaged with an animal for dragging the latter along the ground either with or without the animal supported from a sled accessory (not shown).
Figure 5:
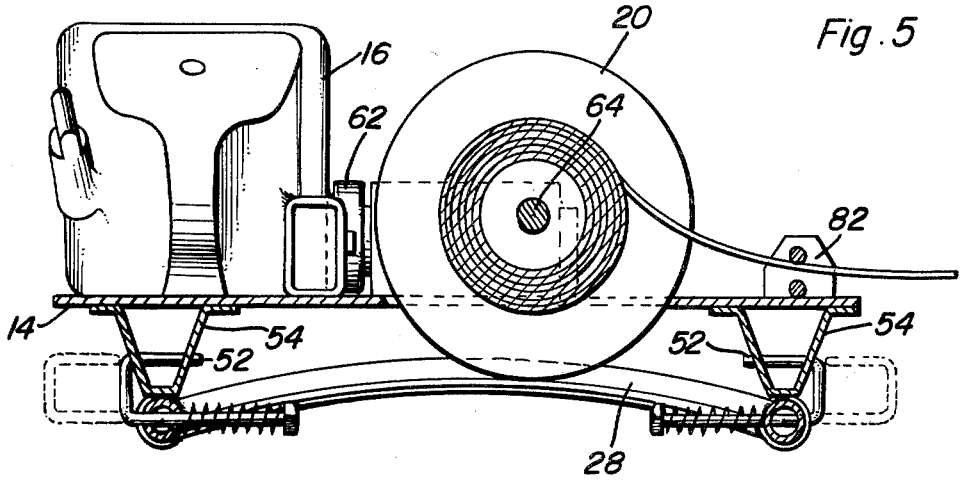
FIG. 5 is a horizontal sectional view taken subtantially upon the plane indicated by the section line 5—5 of FIG. 1.
Figure 6:
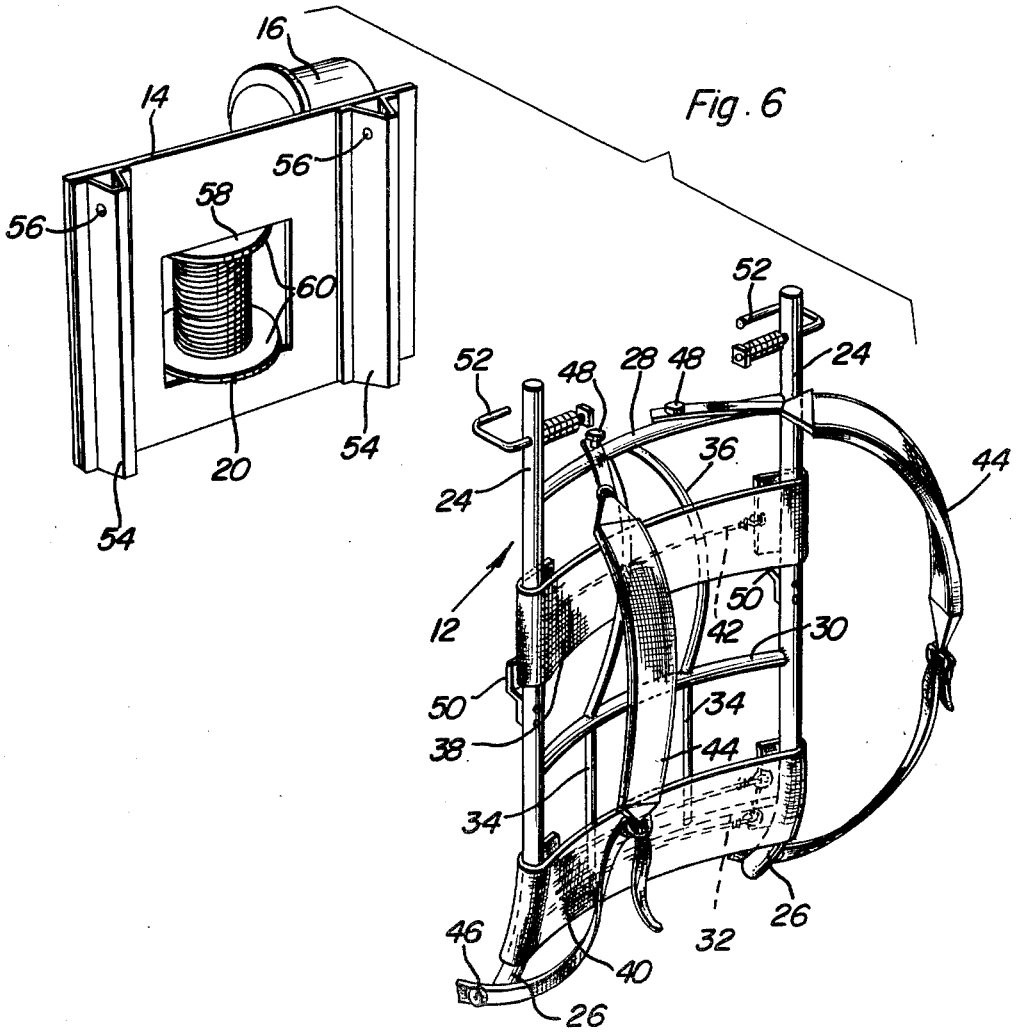
FIG. 6 is a perspective view of the portable power winch with the base plate for the motor and winding member of the winch in exploded position relative to the back frame portion thereof.

Referring now more specifically to the drawings, the numeral 10 generally designates the portable power winch assembly of the instant invention. The winch assembly includes a backpack frame referred to in general by the reference numeral 12 and a mounting plate 14 upon which a gasoline fueled motor 16, a gear reduction assembly 18, a rotatable winding member 20 and a releasable clutch assembly referred to in general by the reference numeral 22 are mounted.

The frame 12 includes a pair of opposite side upstanding longitudinal members 24 having one pair of curved ends 26. The longitudinal members 24 are interconnected by means of arched transverse members 28, 30 and 32 extending and secured between corresponding longitudinally spaced portions of the longitudinal members 24 and the convex sides of the anchored transverse members 28 face outwardly of the same side of the frame 12. Short longitudinal central members 34 extend between the rigidly interconnect midportions of the transverse members 30 and 32 and a second pair of curved longitudinal members 36 extend between and connect central portions of the transverse members 28 and 30. Further, a pair of wide flexible straps 38 and 40 extend between corresponding longitudinally spaced portions of the longitudinal members 24 and the free ends of the straps 38 and 40 are reversely bent about the longitudinal members 24 and interconnected by means of tension members 42 and 43 extending between and secured thereto.

A pair of adjustable length shoulder straps 44 have one pair of corresponding ends thereof anchored to the curved ends 26 as at 46 and the other pair of corresponding ends thereof anchored to midportions of the transverse member 28 as at 48. Further, longitudinal midportions of the longitudinal members 24 include offset brackets 50 projecting outwardly of the side of the frame 12 to which the convex side of the transverse members 28, 30 and 32 face and the ends of the longitudinal members 24 remote from the curved ends 26 include transverse spring biased latching pins 52.

The mounting plate 14 includes a pair of longitudinally extending V-shaped channel members 54 secured thereto and one pair of open ends of the channel members 54 are adapted to telescopingly receive the offset portions of the brackets 50 therein. The other pair of ends of the channel members 54 include transverse bores 56 through which the pins 52 are engageable. Accordingly, the mounting plate 14 may be releasably supported from the side of the frame 12 to which the convex sides of the transverse members 28, 30 and 32 face. The channel members 54 abut against the longitudinal members 24 and space the mounting plate 14 from the side of the frame to which the convex sides of the transverse members 28, 30 and 32 face. The central portion of the mounting plate 14 includes an opening 58 formed therethrough and the winding member 20 comprises a winding drum including opposite end flanges 60 which project through the opening 58 short of positions projecting outwardly from the concave sides of the transverse members 28, 30 and 32.

The motor 16 comprises the power head of a portable chain saw and the output shaft of the motor 16 is coupled, by means of a coupling 62 to the input shaft of the gear reduction assembly 18. The gear reduction assembly 18 is secured to the mounting plate 14 in any convenient manner and includes an output shaft 64 upon which the winding member 20 is freely rotatable. However, the clutch assembly 22 includes a dog clutch member 66 splined, and thus shiftable longitudinally of and keyed to the shaft 64 for rotation therewith. The clutch member 66 includes axially facing clutch pins 68 which are telescopingly receivable in circularly arranged axially outwardly opening recesses formed in the adjacent end flanges 60 of the winding member 20. A clutch lever 70 is pivotally supported from a mount 72 supported from the plate 14 and the lever 70 includes an actuating arm 74 provided with a handle 76 and a bifurcated shifting fork 78 engaged in a circumferential groove 80 formed in the clutch member 66. Accordingly, the clutch member 66 may be shifted axially of the shaft 64 upon oscillation of the clutch lever 70 between a release position with the pins 68 withdrawn from the corresponding recesses and an applied position with the pins fully seated in the corresponding recesses. The lever 70 includes a detent 79 for maintaining the latter in the clutch release position and a compression spring 80 is disposed about the shaft 64 and yieldingly biases the clutch member 66 to its applied position.

One marginal portion of the mounting plate 14 includes fair lead structure 82 for guidingly receiving the free end of a cable 84 wound on the winding member 20 and the four corner portions of the mounting plate 14 have threaded bolts 86 secured therethrough provided with pivotally attached bails 88 to which the free ends of an anchor bridle (not shown) may be attached. It is to be noted that when an anchor bridle is to be used to anchor the mounting plate 14 against movement, the bridle assembly may be anchored relative to a convenient tree or rock. Further, the bridle (not shown) may be anchored relative to the ground by means of a ground spike which may also be provided as an accessory.

In operation, the complete portable power winch assembly 10 may be readily backpacked by a hunter to an area in which hunting is to be carried out and an accessory sled, the accessory bridle and the accessory ground spike may be backpacked by a companion hunter or the same hunter backpacking the assembly 10.

When the heavy kill is made, the mounting plate 14 may be disengaged from the backpack frame 12 and anchored relatively to any suitable object such as a tree, a rock, or the ground, by means of the aforementioned bridle, and the clutch lever 70 may be swung to the release position. Thereafter, the free end of the cable 84 may be pulled to unwind the cable 84 from the winding member 20 and the free end of the cable 84 may be secured to the kill 90 or the accessory sled upon which the kill rests. Thereafter, the clutch lever 70 may be swung to the clutch applied position thereof and the motor 16, equipped with its own centrifugal clutch (not shown), may be started. Thereafter, upon increasing the speed of operation of the motor 16, the latter will drive the winding member 20 to cause the cable 84 to be wound thereon and the kill 90 to be dragged toward the portable power winch assembly 10. If the companion hunter has also packed a lightweight sled, the kill 90 may be supported from the sled and the free end of the cable 84 may be anchored relative to the sled. In this manner, the sled may be utilized to support the kill 90 as the sled, and thus the kill 90 is drawn toward the winding member 20. When the kill 90 has been drawn to a position closely adjacent the winding member 20, operation of the motor 16 is terminated and the clutch lever 70 is pivoted to the release position thereof. Thereafter, the mounting plate 14 may be transported further in the direction of intended movement of the kill 90 and again suitably anchored, the cable being unwound from the winding member 20 during movement of the mounting plate 14 to the next point adjacent to which it will be anchored. Thereafter, the mounting plate 14 is again anchored and the clutch lever 70 is swung to the applied position and the motor 16 is restarted. The above foregoing process may be repeated as desired until the kill 90 has been moved to a road or trail along which a motorized vehicle may travel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a light weight support frame, a combined motor and winch assembly including a rotary winding member and means drivingly connecting said motor to said winding member supported from said frame, said frame including elongated opposite side members interconnected by means of bowed transverse members extending and secured between said side members at points spaced therealong with the convex sides of said transverse members facing outwardly of one side of said frame, said motor and winch assembly being supported from and projecting outwardly of said one side of said frame, shoulder strap means supported from said frame for support of said frame from the back of a person over whose shoulders said shoulder strap means pass with the concave sides of said transverse members opposing and extending transversely of said back, a base plate, means removably supporting and anchoring said base plate to said frame, said motor and winch assembly being supported from the side of said base plate remote from said frame, said opposite side members including generally straight and parallel major length portions, said plate including a pair of parallel channel members extending along, opening laterally outwardly toward and anchored to the side of said plate opposing said frame, the outer portions of said channel members abutting and extending along said major length portions, each of one pair of ends of said channel members including a pair of aligned opposite side transverse bores formed therethrough, said opposite side members each including slightly outwardly offset bracket portions removably telescopically received within the other pair of corresponding ends of said channel members, said opposite side members including elongated spring biased pin portions reciprocately supported therefrom for lengthwise shifting of said pin portions transversely of said opposite side members, said pin portions being lengthwise received through the corresponding bores and lengthwise retractable therefrom, said pin portions and offset bracket portions serving to releasably anchor said plate to said frame.

2. The combination of claim 1 wherein said base plate includes fair lead means supported therefrom through which to guidingly receive the free end of an elongated flexible tension member wound on said winding member.

3. The combination of claim 1 wherein said means drivingly connecting said motor to said winding motor including releasable clutch means, said clutch means including release means for releasing the driving connection of said motor to said winding member to allow free wheeling rotation of said winding member.

4. The combination of claim 3 wherein said means drivingly connecting said motor to said winding member also includes gear reduction torque transfer means intermediate said motor and clutch means.

5. The combination of claim 1 wherein said base plate includes fair lead means supported therefrom through which to guidingly receive the free end of an elongated flexible tension member wound on said winding member, said fair lead means being supported from said base plate adjacent one longitudinal side of said frame, and anchor means spaced along said base plate adjacent the other longitudinal side of said frame and a line generally normal to a line extending between said winding member and said fair lead means, said anchor means being adapted to have the opposite ends of a ground anchored bridle anchored relative thereto.

* * * * *